US007723601B2

(12) United States Patent
Kamath et al.

(10) Patent No.: US 7,723,601 B2
(45) Date of Patent: May 25, 2010

(54) SHARED BUFFER MANAGEMENT FOR PROCESSING AUDIO FILES

(75) Inventors: Nidish Ramachandra Kamath, Placentia, CA (US); Prajakt V Kulkarni, San Diego, CA (US); Suresh Devalapalli, San Diego, CA (US); Allister Alemania, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 274 days.

(21) Appl. No.: 12/041,855

(22) Filed: Mar. 4, 2008

(65) Prior Publication Data

US 2008/0229912 A1 Sep. 25, 2008

Related U.S. Application Data

(60) Provisional application No. 60/896,425, filed on Mar. 22, 2007.

(51) Int. Cl.
*G10H 7/00* (2006.01)

(52) U.S. Cl. ..... 84/604; 84/601; 84/603

(58) Field of Classification Search ..... None
See application file for complete search history.

(56) References Cited

U.S. PATENT DOCUMENTS

| | | | | |
|---|---|---|---|---|
| 4,393,740 | A * | 7/1983 | Niezgoda et al. | 84/659 |
| 5,895,469 | A | 4/1999 | Lahti et al. | |
| 6,058,066 | A | 5/2000 | Norris et al. | |
| 7,256,340 | B2 * | 8/2007 | Okazaki et al. | 84/604 |
| 2004/0069118 | A1 * | 4/2004 | Okazaki et al. | 84/603 |
| 2006/0081118 | A1 * | 4/2006 | Okazaki et al. | 84/604 |
| 2006/0086237 | A1 * | 4/2006 | Burwen | 84/630 |
| 2008/0289479 | A1 * | 11/2008 | Matsuhashi et al. | 84/604 |
| 2009/0095145 | A1 * | 4/2009 | Streich et al. | 84/609 |
| 2009/0287323 | A1 * | 11/2009 | Kobayashi | 700/94 |

FOREIGN PATENT DOCUMENTS

EP 0752697 1/1997

(Continued)

OTHER PUBLICATIONS

International Search Report, PCT/US08/057230, International Search Authority, European Patent Office, Jul. 10, 2008.

(Continued)

*Primary Examiner*—Marlon T Fletcher
(74) *Attorney, Agent, or Firm*—Espartaco Diaz Hidalgo

(57) ABSTRACT

This disclosure describes techniques that make use of a summing buffer that receives waveform samples from audio processing elements, and sums and stores the waveform sums for a given frame. In one example, a method comprises summing a waveform sample received from an audio processing element to produce a waveform sum associated with a first audio frame, storing the waveform sum in a memory, wherein the memory is logically partitioned into a plurality of memory blocks, and locking memory blocks containing the waveform sum associated with the first audio frame, transferring contents of locked memory blocks to an external processor, unlocking a memory block after contents of the memory block have been transferred to the external processor, and storing a waveform sum associated with a second audio frame within the unlocked memory block concurrently with transferring contents of remaining locked memory blocks associated with the first audio frame.

54 Claims, 6 Drawing Sheets

FOREIGN PATENT DOCUMENTS

| | | |
|---|---|---|
| EP | 0872796 | 10/1998 |
| JP | 2004206369 | 7/2004 |

OTHER PUBLICATIONS

Written Opinion, PCT/US08/057230, International Search Authority, European Patent Office, Jul. 10, 2008.

McCulley, "Streaming Wave Files with DirectSound," GAMEDEV.NET, Sep. 14, 1999, pp. 1-2, Retrieved from the Internet, XP002484300.

Roads, "Internet Music Tutorial," MIT Press, 1996, pp. 1039-1041, MIT Press, Cambridge, MA, USA, XP002484301.

* cited by examiner

SHARED BUFFER MANAGEMENT FOR PROCESSING AUDIO FILES

RELATED APPLICATIONS

Claim of Priority under 35 U.S.C. §119

The present Application for Patent claims priority to Provisional Application Ser. No. 60/896,425 entitled "SHARED BUFFER MANAGEMENT FOR PROCESSING AUDIO FILES" filed Mar. 22, 2007, and assigned to the assignee hereof and hereby expressly incorporated by reference herein.

TECHNICAL FIELD

This disclosure relates to audio devices and, more particularly, to audio devices that generate audio output based on audio formats such as musical instrument digital interface (MIDI) or similar formats.

BACKGROUND

Musical Instrument Digital Interface (MIDI) is a format used in the creation, communication and/or playback of audio sounds, such as music, speech, tones, alerts, and the like. A device that supports the MIDI format playback may store sets of audio information that can be used to create various "voices." Each voice may correspond to one or more sounds, such as a musical note by a particular instrument. For example, a first voice may correspond to a middle C as played by a piano, a second voice may correspond to a middle C as played by a trombone, a third voice may correspond to a D# as played by a trombone, and so on. In order to replicate the musical note as played by a particular instrument, a MIDI compliant device may include a set of information for voices that specify various audio characteristics, such as the behavior of a low-frequency oscillator, effects such as vibrato, and a number of other audio characteristics that can affect the perception of sound. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be coded in accordance with the MIDI format by specifying events that indicate when certain voices should start and stop. In this way, the musical composition may be stored and transmitted in a compact file format according to the MIDI format.

MIDI is supported in a wide variety of devices. For example, wireless communication devices, such as radiotelephones, may support MIDI files for downloadable sounds such as ringtones or other audio output. Digital music players, such as the "iPod" devices sold by Apple Computer, Inc and the "Zune" devices sold by Microsoft Corporation may also support MIDI file formats. Other devices that support the MIDI format may include various music synthesizers, wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, various computerized toys for children, on-board computers used in automobiles, watercraft and aircraft, and a wide variety of other devices.

SUMMARY

In general, this disclosure describes techniques for processing audio files. The techniques may be particularly useful for playback of audio files that comply with the musical instrument digital interface (MIDI) format, although the techniques may be useful with other audio formats, techniques or standards. As used herein, the term MIDI file refers to any file that contains at least one audio track that conforms to a MIDI format. According to this disclosure, techniques make use of a summing buffer that operates to receive waveform samples from a plurality of audio processing hardware elements. When the summing buffer receives a calculated waveform from one of the processing elements, the summing buffer adds the calculated waveform to the proper instance of time associated with an overall waveform for a MIDI frame. Thus, the summing buffer combines output of the plurality of processing elements. In this way, the summing buffer accumulates and stores an overall digital representation of a waveform for a full MIDI frame. The summing buffer essentially sums the different instances of time associated with different generated voices from different ones of the processing elements in order to create audio samples representative of an overall audio compilation within a given audio frame.

The summing buffer transfers the audio samples for a first audio frame to an external processor such as a digital signal processor (DSP). The summing buffer includes a memory module that may be logically partitioned into a plurality of memory blocks that may be independently locked and unlocked by the summing buffer, i.e., on a block-by-block basis. When transfer to the DSP is completed for a given memory block within the memory module, the summing buffer unlocks the memory block. Without waiting for completion of the transfer of all the memory blocks of memory module to the DSP for the first frame, the summing buffer begins clearing the contents of the unlocked memory blocks, and allows waveform sums for a second frame (i.e., the next frame) to be written to the cleared memory blocks.

As a result of these techniques, the summing buffer may receive waveform samples from audio processing hardware elements and store the resulting waveform sums to memory even while a transfer of waveform sums to a digital signal processor (DSP) is still in progress for the previous frame. In this manner, the summing buffer is designed to efficiently sum waveform samples from audio processing elements and provide the resulting waveform sums for each frame to the DSP. Moreover, offloading the memory management functions from the audio processing hardware elements to the summing buffer may increase the throughput of audio processing hardware elements.

In one aspect, this disclosure provides a method comprising summing a waveform sample received from an audio processing element to produce a waveform sum associated with a first audio frame, storing the waveform sum associated with the first audio frame in a memory, wherein the memory is logically partitioned into a plurality of memory blocks, and locking memory blocks containing the waveform sum associated with the first audio frame. The method further comprises transferring contents of the locked memory blocks to an external processor on a block-by-block basis, unlocking a memory block after contents of the memory block have been transferred to the external processor, and storing a waveform sum associated with a second audio frame within the unlocked memory block concurrently with transferring contents of remaining locked memory blocks containing waveform sums associated with the first audio frame.

In another aspect, this disclosure provides a device comprising an accumulator that sums a waveform sample received from an audio processing element to produce a waveform sum associated with a first audio frame, a memory that stores the waveform sum associated with the first audio frame, wherein the memory is logically partitioned into a plurality of memory blocks, and a control unit that locks memory blocks containing the waveform sum associated with the first audio frame. The control unit transfers contents of the locked memory blocks to an external processor on a block-by-block basis, and unlocks a memory block after contents of the memory block have been transferred to the external processor. The memory stores a waveform sum associated with a second audio frame within the unlocked memory block concurrently with the control unit transferring contents of remaining locked memory blocks containing waveform sums associated with the first audio frame.

In another aspect, this disclosure provides a device comprising means for summing a waveform sample received from an audio processing element to produce a waveform sum associated with a first audio frame, means for storing the waveform sum associated with the first audio frame, wherein the means for storing is logically partitioned into a plurality of memory blocks, and means for locking blocks containing the waveform sum associated with the first audio frame. The device also includes means for transferring contents of the locked memory blocks to an external processor on a block-by-block basis, and means for unlocking a memory block after contents of the memory block have been transferred to the external processor, wherein a waveform sum associated with a second audio frame is stored within the unlocked memory block by the means for storing concurrently with contents of remaining locked memory blocks containing waveform sums associated with the first audio frame being transferred to the external processor by the means for transferring.

In another aspect, this disclosure provides a computer-readable medium comprising instructions that upon execution cause one or more processors to sum a waveform sample received from an audio processing element to produce a waveform sum associated with a first audio frame, store the waveform sum associated with the first audio frame in a memory, wherein the memory is logically partitioned into a plurality of memory blocks, lock memory blocks containing the waveform sum associated with the first audio frame, transfer contents of the locked memory blocks to an external processor on a block-by-block basis, unlock a memory block after contents of the memory block have been transferred to the external processor, and store a waveform sum associated with a second audio frame within the unlocked memory block concurrently with transferring contents of remaining locked memory blocks containing waveform sums associated with the first audio frame.

In another aspect, this disclosure provides a circuit adapted to sum a waveform sample received from an audio processing element to produce a waveform sum associated with a first audio frame, store the waveform sum associated with the first audio frame in a memory, wherein the memory is logically partitioned into a plurality of memory blocks, lock memory blocks containing the waveform sum associated with the first audio frame, transfer contents of the locked memory blocks to an external processor on a block-by-block basis, unlock a memory block after contents of the memory block have been transferred to the external processor, and store a waveform sum associated with a second audio frame within the unlocked memory block concurrently with transferring contents of remaining locked memory blocks containing waveform sums associated with the first audio frame.

The details of one or more aspects of this disclosure are set forth in the accompanying drawings and the description below. Other features, objects, and advantages of the invention will be apparent from the description and drawings, and from the claims.

DETAILED DESCRIPTION

Figure 1:
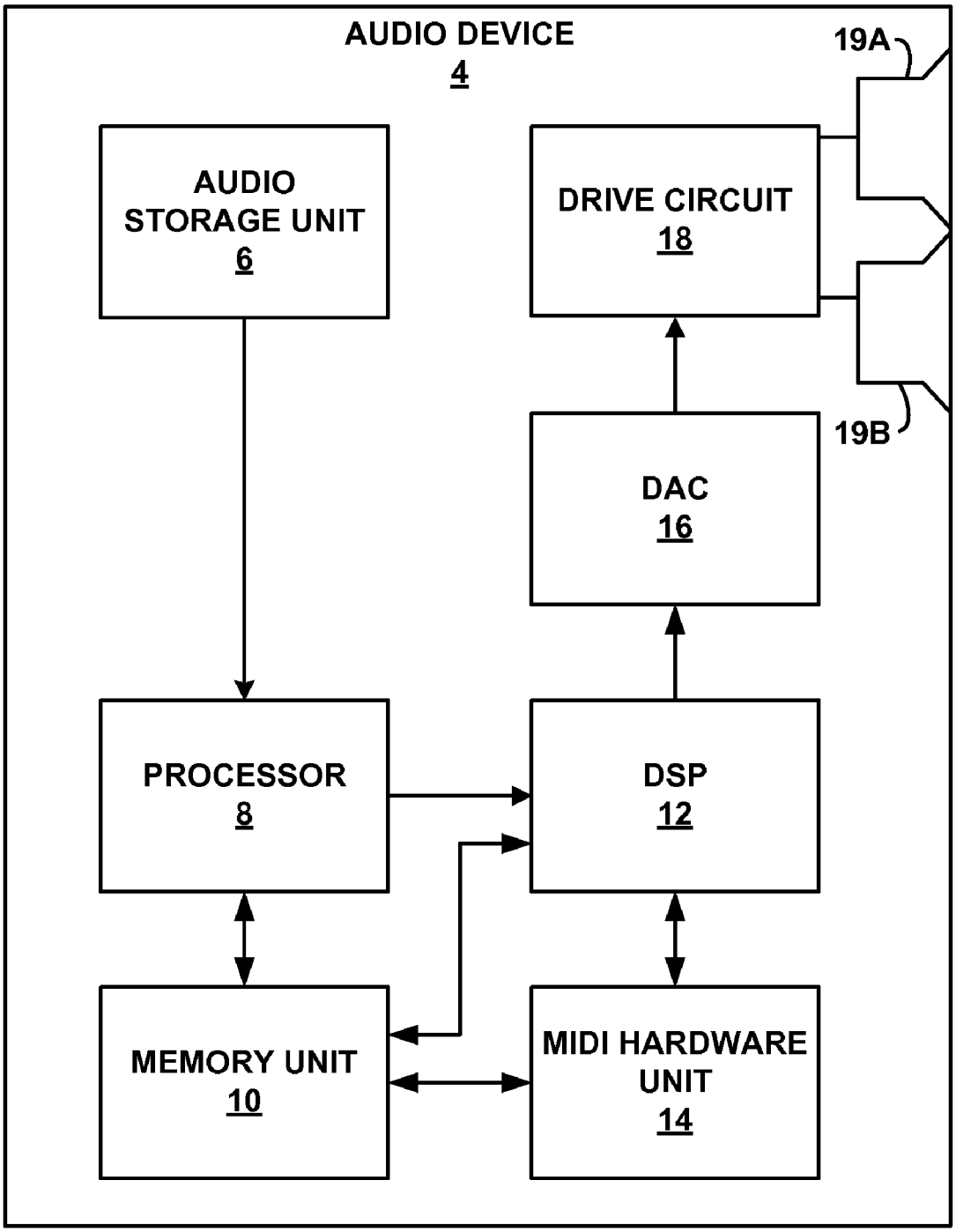
FIG. 1 is a block diagram illustrating an exemplary audio device that may implement the techniques for processing audio files in accordance with this disclosure.

This disclosure describes techniques for processing audio files. The techniques may be particularly useful for playback of audio files that comply with the musical instrument digital interface (MIDI) format, although the techniques may be useful with other audio formats, techniques or standards that make use of synthesis parameters. As used herein, the term MIDI file refers to any audio data or file that contains at least one audio track that conforms to the MIDI format. Examples of various file formats that may include MIDI tracks include CMX, SMAF, XMF, SP-MIDI, to name a few. CMX stands for Compact Media Extensions, developed by Qualcomm Inc. SMAF stands for the Synthetic Music Mobile Application Format, developed by Yamaha Corp. XMF stands for eXtensible Music Format, and SP-MIDI stands for Scalable Polyphony MIDI.

MIDI files or other audio files can be conveyed between devices within audio frames, which may include audio information or audio-video (multimedia) information. An audio frame may comprise a single audio file, multiple audio files, or possibly one or more audio files and other information such as coded video frames. Any audio data within an audio frame may be termed an audio file, as used herein, including streaming audio data or one or more audio file formats listed above. According to this disclosure, techniques make use of a summing buffer that receives waveform samples from each of a plurality of processing elements (e.g., within a dedicated MIDI hardware), and accumulates the waveform samples to produce waveform sums, which are then transferred to a digital signal processor (DSP).

The described techniques may improve processing of audio files, such as MIDI files. The techniques may separate different tasks into software, firmware, and hardware. A general purpose processor may execute software to parse audio files of an audio frame and thereby identify timing parameters, and to schedule events associated with the audio files. The scheduled events can then be serviced by the DSP in a synchronized manner, as specified by timing parameters in the audio files. The general purpose processor dispatches the events to the DSP in a time-synchronized manner, and the DSP processes the events according to the time-synchronized schedule in order to generate synthesis parameters. The DSP then schedules processing of the synthesis parameters in a hardware unit, and the hardware unit can generate audio samples based on the synthesis parameters.

According to this disclosure, when the summing buffer receives a calculated waveform from one of the processing elements, the summing buffer adds the calculated waveform to the proper instance of time associated with an overall waveform for a MIDI frame. Thus, the summing buffer combines output of the plurality of processing elements. In this way, the summing buffer accumulates and stores an overall digital representation of a waveform for a full MIDI frame. The summing buffer essentially sums the different instances of time associated with different generated voices from different ones of the processing elements in order to create audio samples representative of an overall audio compilation within a given audio frame.

FIG. 1 is a block diagram illustrating an exemplary audio device 4. Audio device 4 may comprise any device capable of processing MIDI files, e.g., files that include at least one MIDI track. Examples of audio device 4 include a wireless communication device such as a radiotelephone, a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, a circuit board installed in a device, a kiosk device, a video game console, various computerized toys for children, an on-board computer used in an automobile, watercraft or aircraft, or a wide variety of other devices.

The various components illustrated in FIG. 1 are provided to explain aspects of this disclosure. However, other components may exist and some of the illustrated components may not be included in some implementations. For example, if audio device 4 is a radiotelephone, then an antenna, transmitter, receiver and modem (modulator-demodulator) may be included to facilitate wireless communication of audio files.

As illustrated in the example of FIG. 1, audio device 4 includes an audio storage unit 6 to store MIDI files. Again, MIDI files generally refer to any audio file that includes at least one track coded in a MIDI format. Audio storage unit 6 may comprise any volatile or non-volatile memory or storage. For purposes of this disclosure, audio storage unit 6 can be viewed as a storage unit that forwards MIDI files to processor 8, or processor 8 retrieves MIDI files from audio storage unit 6, in order for the files to be processed. Of course, audio storage unit 6 could also be a storage unit associated with a digital music player or a temporary storage unit associated with information transfer from another device. Audio storage unit 6 may be a separate volatile memory chip or non-volatile storage device coupled to processor 8 via a data bus or other connection. A memory or storage device controller (not shown) may be included to facilitate the transfer of information from audio storage unit 6.

In accordance with this disclosure, device 4 implements an architecture that separates MIDI processing tasks between software, hardware and firmware. In particular, device 4 includes a processor 8, a DSP 12 and an audio hardware unit 14. Each of these components may be coupled to a memory unit 10, e.g., directly or via a bus. Processor 8 may comprise a general purpose processor that executes software to parse MIDI files and schedule MIDI events associated with the MIDI files. The scheduled events can be dispatched to DSP 12 in a time-synchronized manner and thereby serviced by DSP 12 in a synchronized manner, as specified by timing parameters in the MIDI files. DSP 12 processes the MIDI events according to the time-synchronized schedule created by general purpose processor 8 in order to generate MIDI synthesis parameters. DSP 12 may also schedule subsequent processing of the MIDI synthesis parameters by audio hardware unit 14. Audio hardware unit 14 generates audio samples based on the synthesis parameters. In alternative embodiments, the functionality described herein may be implemented in another manner, such as in software or in a circuit adapted to perform the techniques described herein.

Processor 8 may comprise any of a wide variety of general purpose single- or multi-chip microprocessors. Processor 8 may implement a CISC (Complex instruction Set Computer) design or a RISC (Reduced Instruction Set Computer) design. Generally, processor 8 comprises a central processing unit (CPU) that executes software. Examples include 16-bit, 32-bit or 64-bit microprocessors from companies such as Intel Corporation, Apple Computer, Inc, Sun Microsystems Inc., Advanced Micro Devices (AMD) Inc., and the like. Other examples include Unix- or Linux-based microprocessors from companies such as International Business Machines (IBM) Corporation, RedHat Inc., and the like. The general purpose processor may comprise the ARM9, which is commercially available from ARM Inc., and the DSP may comprise the QDSP4 DSP developed by Qualcomm Inc.

Processor 8 may service MIDI files for a first frame (frame N), and when the first frame (frame N) is serviced by DSP 12, a second frame (frame N+1) can be simultaneously serviced by processor 8. When the first frame (frame N) is serviced by audio hardware unit 14, the second frame (frame N+1) is simultaneously serviced by DSP 12 while a third frame (frame N+2) is serviced by processor 8. In this way, MIDI file processing is separated into pipelined stages that can be processed at the same time, which can improve efficiency and possibly reduce the computational resources needed for given stages. DSP 12, for example, may be simplified relative to conventional DSPs that execute a full MIDI algorithm without the aid of a processor 8 or MIDI hardware 14.

In some cases, audio samples generated by MIDI hardware 14 are delivered back to DSP 12, e.g., via interrupt-driven techniques. In this case, DSP may also perform post-processing techniques on the audio samples. DAC 16 converts the audio samples, which are digital, into analog signals that can be used by drive circuit 18 to drive speakers 19A and 19B for output of audio sounds to a user.

For each audio frame, processor 8 reads one or more MIDI files and may extract MIDI instructions from the MIDI file. Based on these MIDI instructions, processor 8 schedules MIDI events for processing by DSP 12, and dispatches the MIDI events to DSP 12 according to this scheduling. In particular, this scheduling by processor 8 may include synchronization of timing associated with MIDI events, which can be identified based on timing parameters specified in the MIDI files. MIDI instructions in the MIDI files may instruct a particular MIDI voice to start or stop. Other MIDI instructions may relate to aftertouch effects, breath control effects, program changes, pitch bend effects, control messages such as pan left or right, sustain pedal effects, main volume control, system messages such as timing parameters, MIDI control messages such as lighting effect cues, and/or other sound affects. After scheduling MIDI events, processor 8 may provide the scheduling to memory 10 or DSP 12 so that DSP 12 can process the events. Alternatively, processor 8 may execute the scheduling by dispatching the MIDI events to DSP 12 in the time-synchronized manner.

Memory 10 may be structured such that processor 8, DSP 12 and MIDI hardware 14 can access any information needed to perform the various tasks delegated to these different components. In some cases, the storage layout of MIDI information in memory 10 may be arranged to allow for efficient access from the different components 8, 12 and 14.

When DSP 12 receives scheduled MIDI events from processor 8 (or from memory 10), DSP 12 may process the MIDI events in order to generate MIDI synthesis parameters, which may be stored back in memory 10. Again, the timing in which these MIDI events are serviced by DSP is scheduled by processor 8, which creates efficiency by eliminating the need for DSP 12 to perform such scheduling tasks. Accordingly, DSP 12 can service the MIDI events for a first audio frame while processor 8 is scheduling MIDI events for the next audio frame. Audio frames may comprise blocks of time, e.g., 10 millisecond (ms) intervals, that may include several audio samples. The digital output, for example, may result in 480 samples per frame, which can be converted into an analog audio signal. Many events may correspond to one instance of time so that many notes or sounds can be included in one instance of time according to the MIDI format. Of course, the amount of time delegated to any audio frame, as well as the number of samples per frame may vary in different implementations.

Once DSP 12 has generated the MIDI synthesis parameters, audio hardware unit 14 generates audio samples based on the synthesis parameters. DSP 12 can schedule the processing of the MIDI synthesis parameters by audio hardware unit 14. The audio samples generated by audio hardware unit 14 may comprise pulse-code modulation (PCM) samples, which are digital representations of an analog signal that is sampled at regular intervals. Additional details of exemplary audio generation by audio hardware unit 14 are discussed below with reference to FIG. 2.

In some cases, post processing may need to be performed on the audio samples. In this case, audio hardware unit 14 can send an interrupt command to DSP 12 to instruct DSP 12 to perform such post processing. The post processing may include filtering, scaling, volume adjustment, or a wide variety of audio post processing that may ultimately enhance the sound output.

Following the post processing, DSP 12 may output the post processed audio samples to digital-to analog converter (DAC) 16. DAC 16 converts the digital audio signals into an analog signal and outputs the analog signal to a drive circuit 18. Drive circuit 18 may amplify the signal to drive one or more speakers 19A and 19B to create audible sound.

Figure 2:
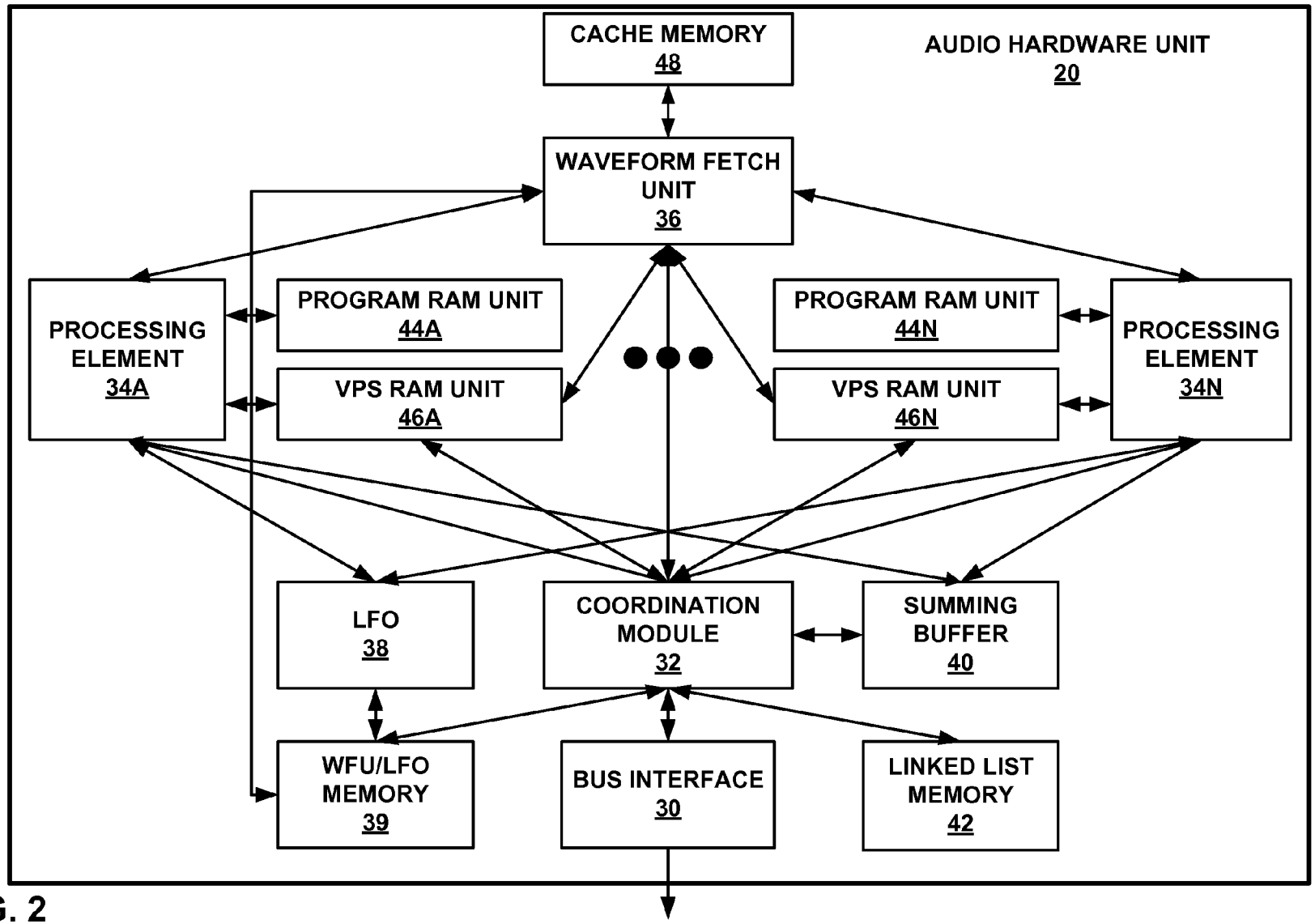
FIG. 2 is a block diagram of one example of a hardware unit for processing audio synthesis parameters according to this disclosure.

FIG. 2 is a block diagram illustrating an exemplary audio hardware unit 20, which may correspond to audio hardware unit 14 of audio device 4 of FIG. 1. The implementation shown in FIG. 2 is merely exemplary as other MIDI hardware implementations could also be defined consistent with the teaching of this disclosure. As illustrated in the example of FIG. 2, audio hardware unit 20 includes a bus interface 30 to send and receive data. For example, bus interface 30 may include an AMBA High-performance Bus (AHB) master interface, an AHB slave interface, and a memory bus interface. AMBA stands for advanced microprocessor bus architecture. Alternatively, bus interface 30 may include an AXI bus interface, or another type of bus interface. AXI stands for advanced extensible interface.

In addition, audio hardware unit 20 may include a coordination module 32. Coordination module 32 coordinates data flows within audio hardware unit 20. When audio hardware unit 20 receives an instruction from DSP 12 (FIG. 1) to begin synthesizing an audio sample, coordination module 32 reads the synthesis parameters for the audio frame, which were generated by DSP 12 (FIG. 1). These synthesis parameters can be used to reconstruct the audio frame. For the MIDI format, synthesis parameters describe various sonic characteristics of one or more MIDI voices within a given frame. For example, a set of MIDI synthesis parameters may specify a level of resonance, reverberation, volume, and/or other characteristics that can affect one or more voices.

At the direction of coordination module 32, synthesis parameters may be loaded directly from memory unit 10 (FIG. 1) into voice parameter set (VPS) RAM 46A or 46N associated with a respective processing element 34A or 34N. At the direction of DSP 12 (FIG. 1), program instructions are loaded from memory 10 into program RAM units 44A or 44N associated with a respective processing element 34A or 34N.

The instructions loaded into program RAM unit 44A or 44N instruct the associated processing element 34A or 34N to synthesize one of the voices indicated in the list of synthesis parameters in VPS RAM unit 46A or 46N. There may be any number of processing elements 34A-34N (collectively "processing elements 34"), and each may comprise one or more ALUs that are capable of performing mathematical operations, as well as one or more units for reading and writing data. Only two processing elements 34A and 34N are illustrated for simplicity, but many more may be included in hardware unit 20. Processing elements 34 may synthesize voices in parallel with one another. In particular, the plurality of different processing elements 34 work in parallel to process different synthesis parameters. In this manner, a plurality processing elements 34 within audio hardware unit 20 can accelerate and possibly increase the number of generated voices, thereby improving the generation of audio samples.

When coordination module 32 instructs one of processing elements 34 to synthesize a voice, the respective one of processing elements 34 may execute one or more instructions defined by the synthesis parameters. Again, these instructions may be loaded into program RAM unit 44A or 44N. The instructions loaded into program RAM unit 44A or 44N cause the respective one of processing elements 34 to perform voice synthesis. For example, processing elements 34 may send requests to a waveform fetch unit (WFU) 36 for a waveform specified in the synthesis parameters. Each of processing elements 34 may use WFU 36. Each of processing elements 34 may use WFU 36. WFU 36 uses an arbitration scheme to resolve any conflicts if two or more processing elements 34 request use of WFU 36 at the same time.

In response to a request from one of processing elements 34, WFU 36 returns one or more waveform samples to the requesting processing element. However, because a wave can be phase shifted within a sample, e.g., by up to one cycle of the wave, WFU 36 may return two samples in order to compensate for the phase shifting using interpolation. Furthermore, because a stereo signal may include two separate waves for the two stereophonic channels, WFU 36 may return separate samples for different channels, e.g., resulting in up to four separate samples for stereo output.

After WFU 36 returns audio samples to one of processing elements 34, the respective processing element may execute additional program instructions based on the audio synthesis parameters. In particular, instructions cause one of processing elements 34 to request an asymmetric triangular wave from a low frequency oscillator (LFO) 38 in audio hardware unit 20. By multiplying a waveform returned by WFU 36 with a triangular wave returned by LFO 38, the respective processing element may manipulate various sonic characteristics of the waveform to achieve a desired audio affect. For example, multiplying a waveform by a triangular wave may result in a waveform that sounds more like a desired musical instrument.

Other instructions executed based on the synthesis parameters may cause a respective one of processing elements 34 to loop the waveform a specific number of times, adjust the amplitude of the waveform, add reverberation, add a vibrato effect, or cause other effects. In this way, processing elements 34 can calculate a waveform for a voice that lasts one MIDI frame. Eventually, a respective processing element may encounter an exit instruction. When one of processing elements 34 encounters an exit instruction, that processing element signals the end of voice synthesis to coordination module 32. The calculated voice waveform can be provided to summing buffer 40 at the direction of another store instruction during the execution of the program instructions. This causes summing buffer 40 to store that calculated voice waveform.

When summing buffer 40 receives a calculated waveform from one of processing elements 34, summing buffer 40 adds the calculated waveform to the proper instance of time associated with an overall waveform for a MIDI frame. Thus, summing buffer 40 combines output of the plurality of processing elements 34. For example, summing buffer 40 may initially store a flat wave (i.e., a wave where all digital samples are zero.) When summing buffer 40 receives audio information such as a calculated waveform from one of processing elements 34, summing buffer 40 can add each digital sample of the calculated waveform to respective samples of the waveform stored in summing buffer 40. In this way, summing buffer 40 accumulates and stores an overall digital representation of a waveform for a full audio frame.

Summing buffer 40 essentially sums different audio information from different ones of processing elements 34. The different audio information is indicative of different instances of time associated with different generated voices. In this manner, summing buffer 40 creates audio samples representative of an overall audio compilation within a given audio frame.

Eventually, coordination module 32 may determine that processing elements 34 have completed synthesizing all of the voices required for the current MIDI frame and have provided those voices to summing buffer 40. At this point, summing buffer 40 contains digital samples indicative of a completed waveform for the current MIDI frame. When coordination module 32 makes this determination, coordination module 32 sends an interrupt to DSP 12 (FIG. 1). In response to the interrupt, DSP 12 may send a request to a control unit in summing buffer 40 (not shown) via direct memory exchange (DME) to receive the content of summing buffer 40. Alternatively, DSP 10 may also be pre-programmed to perform the DME. DME refers to a memory transfer procedure that allows transfer of data from one memory bank to another back in a background process, while DSP 12 is busy doing something else. Following the DME of the content of summing buffer 40 to DSP 12, DSP 12 may then perform any post processing on the digital audio samples, before providing the digital audio samples to DAC 16 for conversion into the analog domain. Importantly, the processing performed by audio hardware unit 20 with respect to a frame N occurs simultaneously with synthesis parameter generation by DSP 12 (FIG. 1) with respect to a frame N+1 and scheduling operations by processor 8 (FIG. 1) with respect to a frame N+2.

Furthermore, as described herein, summing buffer 40 includes a memory that is logically partitioned into a plurality of memory blocks, and operates efficiently by allowing storage and DME transferring from the memory to DSP 12 on a block-by-block basis. In particular, when summing buffer 40 has finished transferring contents of a particular memory block with respect to frame N, summing buffer 40 unlocks and clears the memory block and stores data with respect to frame N+1 to the memory block even as other memory blocks are still undergoing DME transfer with respect to frame N.

Cache memory 48, WFU/LFO memory 39 and linked list memory 42 are also shown in FIG. 2. Cache memory 48 may be used by WFU 36 to fetch base waveforms in a quick and efficient manner. WFU/LFO memory 39 may be used by coordination module 32 to store voice parameters of the voice parameter set. In this way, WFU/LFO memory 39 can be viewed as memories dedicated to the operation of waveform fetch unit 36 and LFO 38. Linked list memory 42 may comprise a memory used to store a list of voice indicators generated by DSP 12. The voice indicators may comprise pointers to one or more synthesis parameters stored in memory 10. Each voice indicator in the list may specify the memory location that stores a voice parameter set for a respective MIDI voice. The various memories and arrangements of memories shown in FIG. 2 are purely exemplary. The techniques described herein could be implemented with a variety of other memory arrangements.

Figure 3:
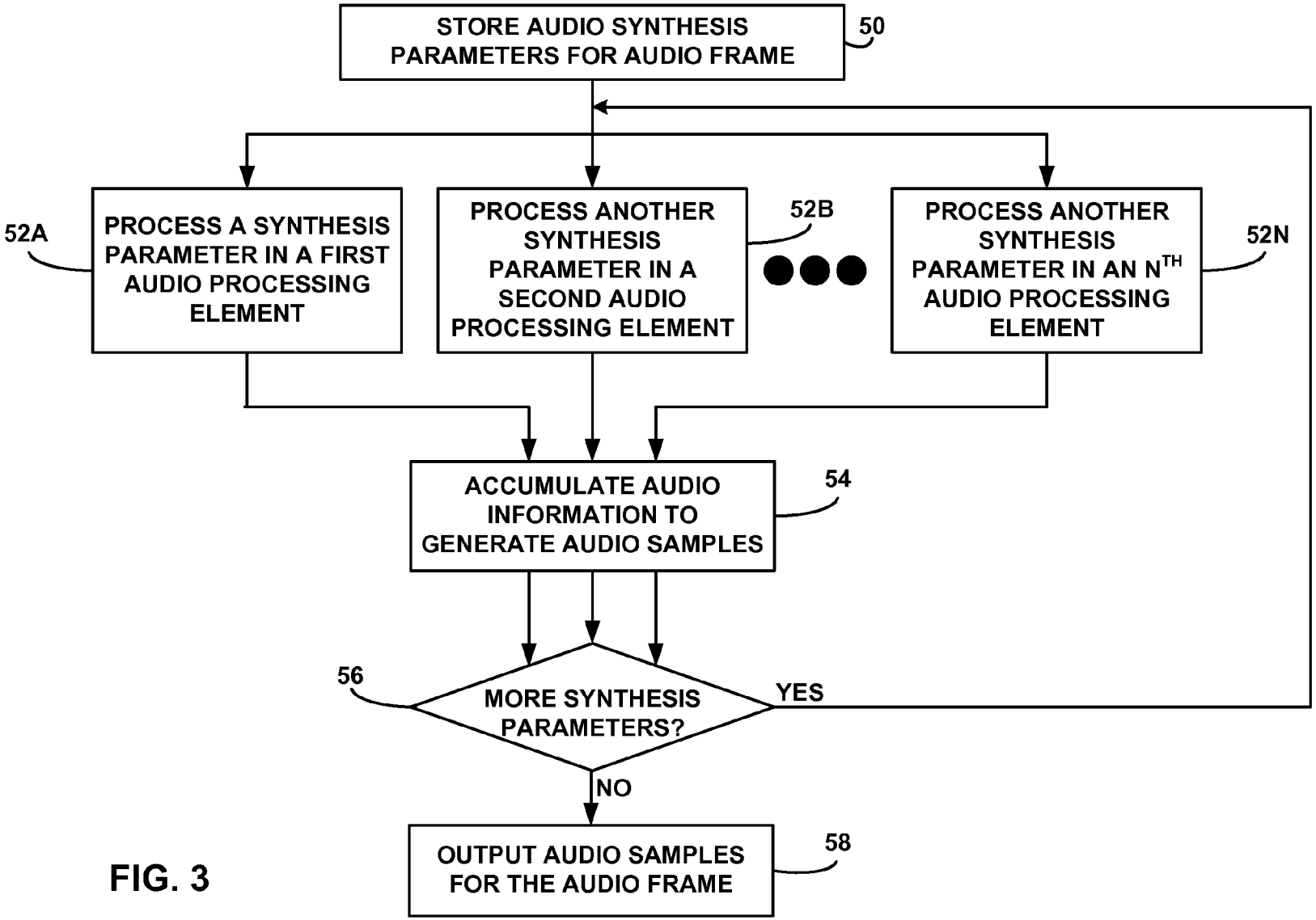
FIG. 3 is a flow diagram illustrating an exemplary technique consistent with the teaching of this disclosure.

FIG. 3 is a flow diagram illustrating an exemplary technique consistent with the teaching of this disclosure. FIG. 3 will be described with reference to device 4 of FIG. 1 and hardware unit 20 of FIG. 2. However, other devices could implement the techniques of FIG. 3. As shown in FIG. 3, memory 10 stores audio synthesis parameters for an audio frame (50). The audio synthesis parameters, for example, may be generated by DSP 12 in processing the scheduled events specified in one or more audio files of the audio frame.

A plurality of different processing elements 34 then simultaneously process different synthesis parameters (52A, 52B, and 52N). In particular, a first synthesis parameter is processed in a first processing element 34A (52A), a second synthesis parameter is processed in a second processing element 34B (52B), and an $N^{th}$ synthesis parameter is processed in an $N^{th}$ processing element 34N (52N). Synthesis parameters may include parameters that define pitch, resonance, reverberation, volume, and/or other characteristics that can affect one or more voices.

Any number of processing elements 34 may be used. Any time that one of processing elements 34 finishes the respective processing, the generated audio information associated with that processing element is accumulated in summing buffer 40 (54) to generate audio samples. If more synthesis parameters exist for the audio frame (yes branch of 56), the respective processing element 34 then processes the next synthesis parameter (52A, 52B, or 52N). This process continues until all of the synthesis parameters for the audio frame are serviced (no branch of 56). At this point, summing buffer 40 outputs the audio samples for the audio frame (58). For example, coordination module 32 may send an interrupt command to DSP 12 (FIG. 1) to cause the audio samples to be sent to DSP 12 for post processing.

Figure 4:
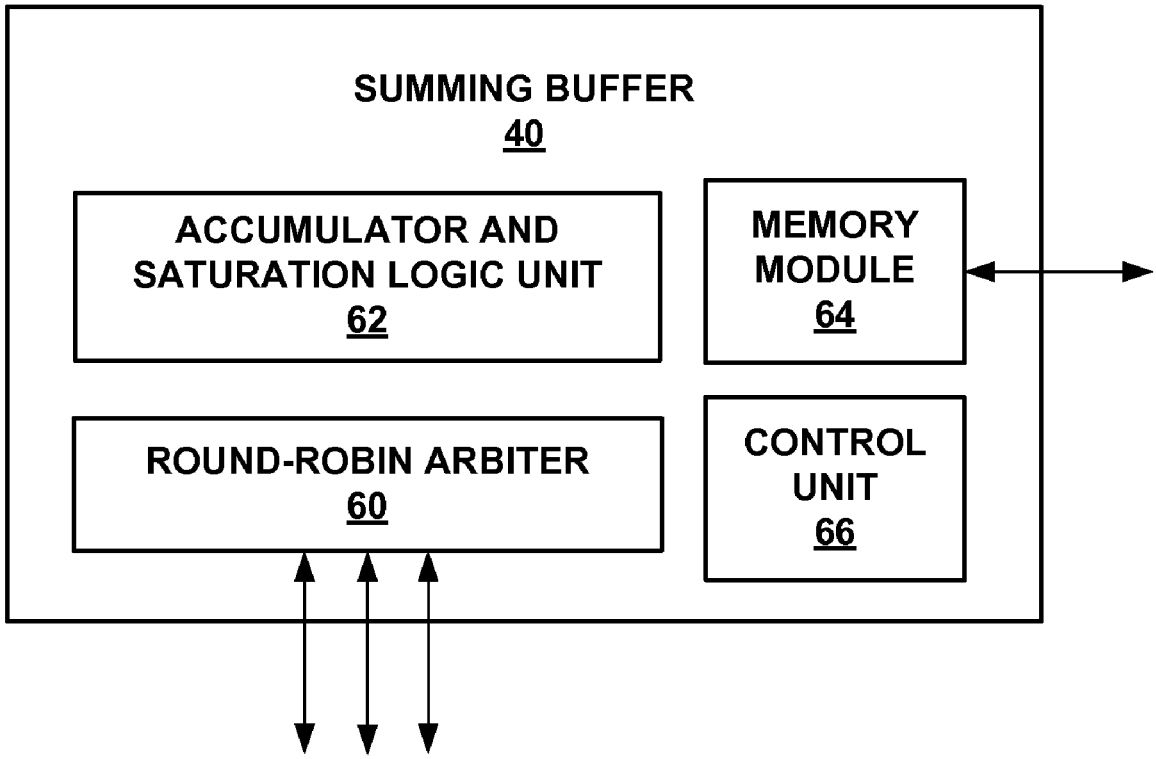
FIG. 4 is a block diagram illustrating an exemplary architecture of a summing buffer according to this disclosure.

FIG. 4 is a block diagram illustrating an exemplary architecture of summing buffer 40 according to this disclosure. Round-robin arbiter 60 receives requests from processing elements 34A-34N to sum waveform samples, and arbitrates the requests in a round-robin fashion. Accumulator and saturation logic unit 62 accumulates the waveform samples received from processing elements 34. For example, accumulator and saturation logic unit 62 may include a two's complement (2C) accumulator for accumulating waveform samples to waveform sums, and may saturate at a given number of bits, e.g., 24 bits. Accumulator and saturation logic unit 62 may have independent accumulators for the two audio channels (left and right), and may sum each channel separately. Control unit 66 stores the accumulated waveform samples (referred to herein as "waveform sums") that represent the accumulation of all the audio voices (e.g., MIDI voices) within memory module 64. For example, memory module 64 may store waveform sums corresponding to one audio frame. In some examples, the waveform sums may be in pulse code modulation (PCM) form.

Processing elements 34 sends requests to summing buffer 40 to sum waveform samples. The requests may include the waveform sample to be summed (e.g., in stereo format this includes a left sample and a right sample), and a sample number of the waveform sample that indicates the address of the location at which the sample should be accumulated, i.e., the address of a target memory block within the memory at which the summed waveform sample should be stored. A person having ordinary skill in the art will recognize that in this context, a target memory may be any memory location set aside during the duration of summing waveform samples. Each request may also include two extra signals that specify whether to saturate the result of the accumulator after summing, and whether to accumulate the result or overwrite it. Since each of processing elements 34 sends an address of the target memory block location along with the waveform sample, processing elements 34 do not need to synchronize their execution, and each of processing elements 34 could send waveforms corresponding to different addresses. After summing buffer 40 services a request from one of processing elements 34, round-robin arbiter 60 moves the serviced processing element to the lowest priority level. Round-robin arbiter 60 thereby ensures that all of processing elements 34 have equal access to summing buffer 40.

Control unit 66 receives a request from DSP 12 to initiate a direct memory exchange (DME) transfer of the contents of memory module 64. In response, control unit 66 locks memory module 64, which has the effect of blocking any requests to the locked portions of memory module 64. Memory module 64 may be logically partitioned into a plurality of memory blocks that may be independently locked and unlocked by summing buffer 40, i.e., on a block-by-block basis. As the DME transfer is completed for a given memory block within memory module 64, control unit 66 unlocks the memory block, the contents of which have been transferred to DSP 12. Without waiting for completion of the DME transfer of all the memory blocks of memory module 64, control unit 66 begins clearing the contents of the unlocked memory block(s), and allows waveform sums for the next frame to be written to the cleared memory blocks.

As a result of these techniques, summing buffer 40 may receive waveform samples from processing elements 34 and store the resulting waveform sums to memory module 64 for a given frame even while the DME transfer of waveform sums is still in progress for the previous frame. In this manner, summing buffer 40 is designed to efficiently sum waveform samples from audio processing elements 34 and provide the resulting waveform sums for each frame to DSP 12. The techniques described herein may improve the throughput of audio device 4 (FIG. 1) since processing elements 34 are not idle while DSP 12 is reading data from summing buffer 40, and DSP 12 is not idle while processing elements 34 are providing data to summing buffer 40. Summing buffer 40 may provide the waveform sums to DSP 12 in stereo format.

Accumulator and saturation logic unit 62 may operate in different modes in response to signals received from processing elements 34 with the requests. The signals may enable and disable saturation and accumulation. In normal mode, signals received from a processing element 34 disable saturation but enable accumulation. In this mode, summing buffer 40 reads from memory module 64, accumulates with the value provided by one of processing element 34 and stores it back to memory without saturation. In a saturating and accumulating mode, signals received from a processing element 34 enable both accumulation and saturation, and summing buffer 40 operates to accumulate the waveform sums and saturate. In a non-saturating, write-through mode, signals received from a processing element 34 disable both accumulation and saturation. Summing buffer 40 skips a read of memory module 64, and the left and right channel bits of the waveform sample received from the processing element 34 are written to memory module 64. Operands causing an overflow will cause the resulting sum to roll over. In a saturating, write-through mode, signals received from a processing element 34 enable saturation but disable accumulation. Summing buffer 40 skips a read of memory module 64 and the left and right channel bits of the waveform sample received from the processing element 34 are written to memory module 64. Overflow is assumed to occur if bits 31:23 (63:55 for the right channel) are not all ones or not all zeros. In the case of overflow, the sample is positively or negatively saturated based on bit 31 (bit 63 for the right channel).

Figure 5:
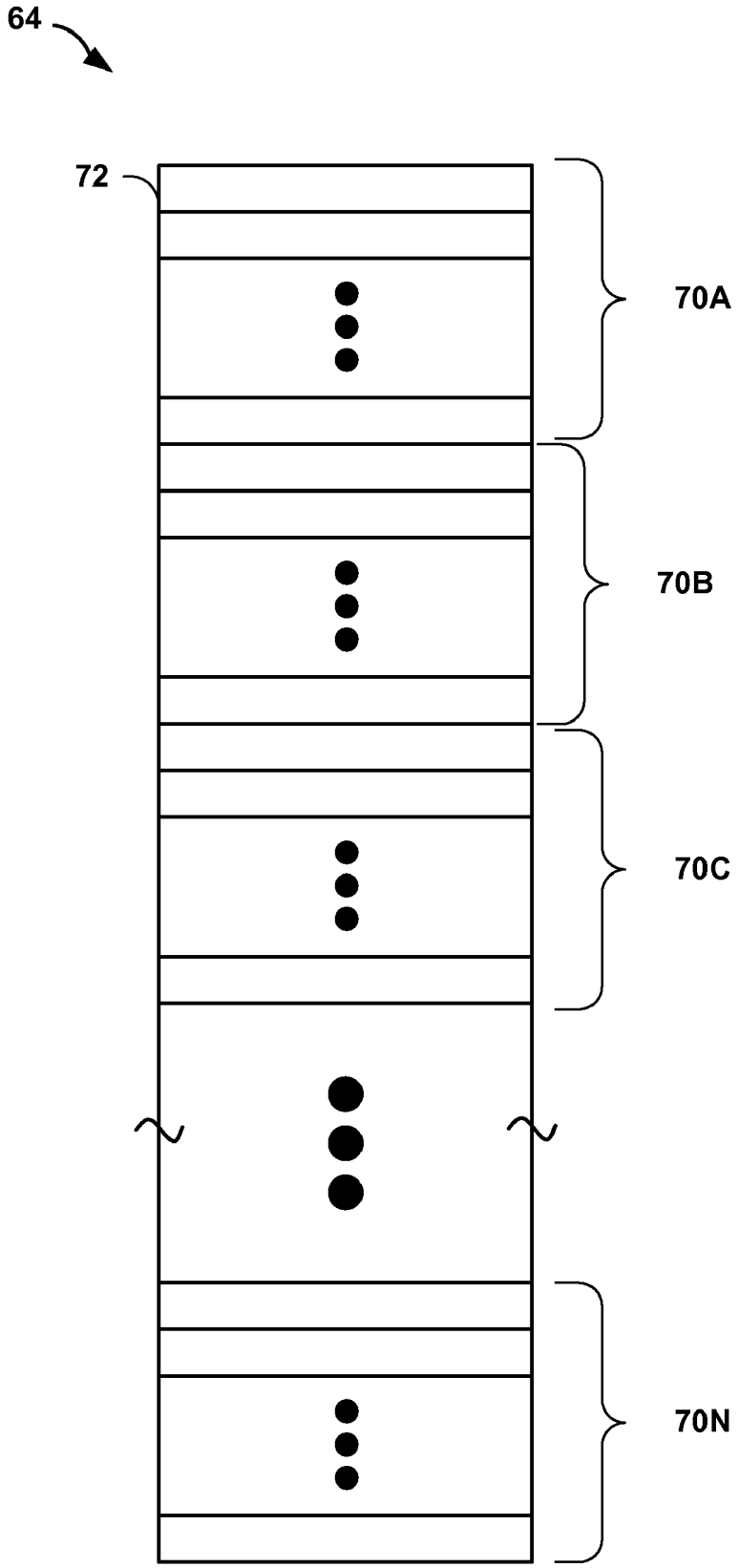
FIG. 5 is a block diagram illustrating an exemplary memory module maintained by the summing buffer.

FIG. 5 is a block diagram illustrating an exemplary memory module 64 maintained by summing buffer 40. In the example of FIG. 5, memory module 64 is logically partitioned into multiple blocks of memory 70A-70N (collectively, "memory blocks 70"). Each memory block 70 may include one or more words 72, wherein each of words 72 corresponds to a different waveform sum. As illustrated, memory blocks 70 and words 72 within memory blocks 70 may correspond to increasing instances of time from the top of memory module 64 to the bottom. Memory blocks 70 may be independently lockable to prevent a given memory block 70 from being cleared or written to. In one example, memory module 64 contains sixteen memory blocks, where each memory block consists of thirty-two words 72, each word 72 having size of 48 bits.

In one example implementation, memory module 64 stores waveform sums corresponding to one audio frame, where one audio frame is defined as ten milliseconds of audio data. At a sampling frequency of 48 kHz, the number of waveform sums per frame would be 480 waveform sums per frame. Summing buffer 40 may be designed to be able to clear one waveform sum's worth of data from memory module 64 per cycle. Thus, at the sampling frequency of 48 kHz, summing buffer 40 can take a minimum of 480 cycles to clear the entirety of memory module 64.

In one example, summing buffer 40 receives waveform samples from audio processing elements 34 as 64-bits with bits 55:32 being a 24-bit two's complement (2C) right sample and bits 23:0 being the 24-bit 2C left sample. Accumulator and saturation logic unit 62 adds the received waveform sample to the proper instance of time associated with an overall waveform for a MIDI frame, based on a sample number received with the waveform sample. The sample number that indicates the address of the location where the waveform sample (i.e., the 2C right sample and 2C left sample) should be accumulated. For example, summing buffer 40 may initially store a flat wave within memory module 64 (i.e., a wave where all digital samples are zero). When summing buffer 40 receives a waveform sample from one of processing elements 34, summing buffer 40 can add each digital sample of the waveform sample to sums of respective samples of the waveform stored in memory module 64. Thus, accumulator and saturation logic unit 62 adds together all waveform samples received from each of the processing elements 34 that correspond to a given instance of time (and therefore correspond to a given location within memory module 64), and stores the sum at the location. In this way, summing buffer 40 accumulates and stores an overall digital representation of a waveform for a full MIDI frame. Summing buffer 40 may store the waveform sums within memory module 64 as 48-bit words 72, each word 72 including a 2C right channel sum and a 2C left channel sum. For example, the waveform sums may be stored within memory module 64 with bits 47:24 being the 2C right channel sum and bits 23:0 being the 2C left channel sum.

Figure 6:
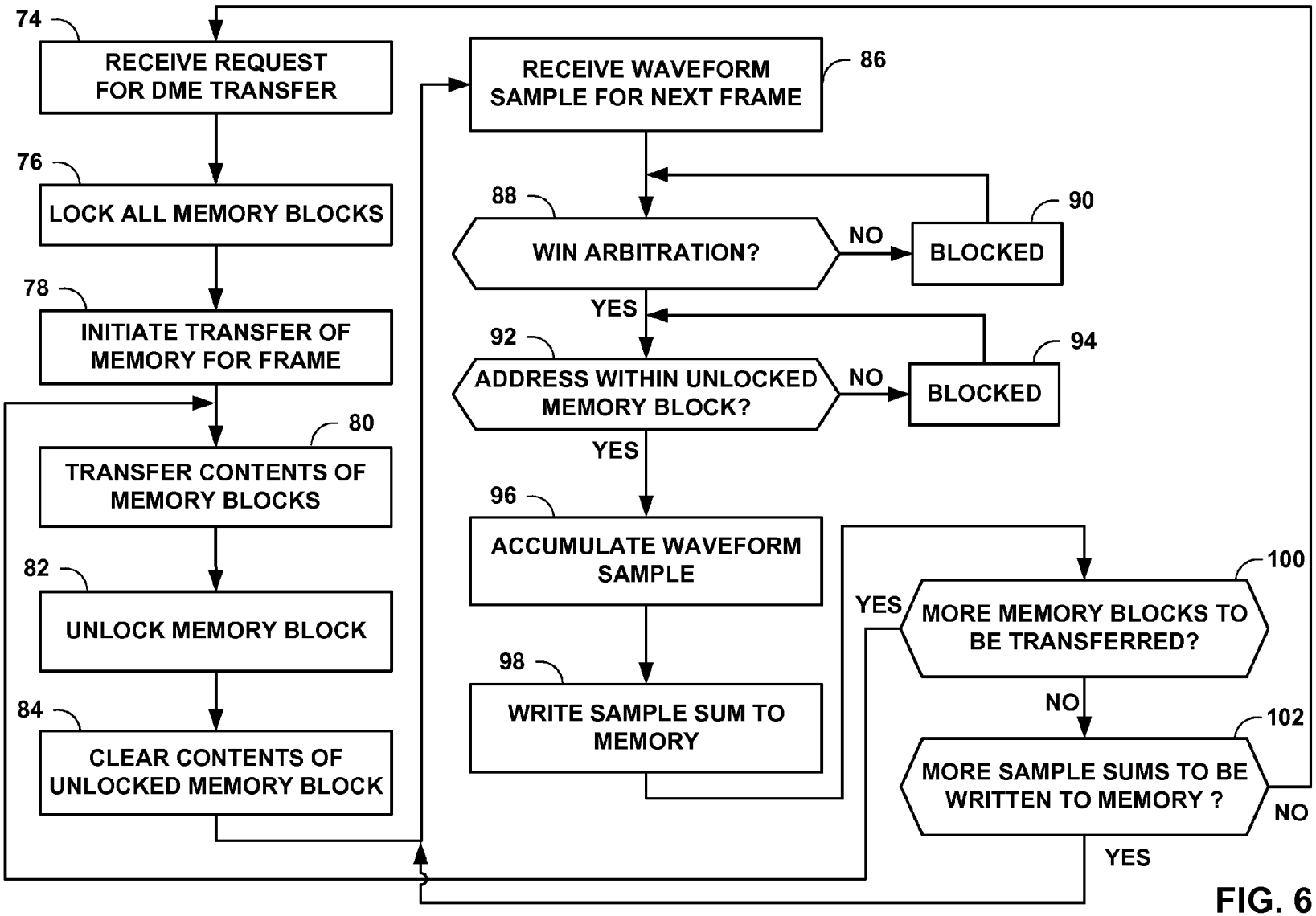
FIG. 6 is a flow diagram illustrating an exemplary technique consistent with the teaching of this disclosure.

FIG. 6 is a flow diagram illustrating an exemplary technique consistent with the teaching of this disclosure. Control unit 66 of summing buffer 40 receives a request from DSP 12 to initiate a direct memory exchange (DME) transfer of the contents of memory module 64 (74). In response, control unit 66 locks memory module 64 (76), which has the effect of blocking any requests to the locked portions of memory module 64. As the DME transfer is completed for a given memory block within memory module 64 (80), control unit 66 unlocks the memory block (82), the contents of which have been transferred to DSP 12. Without waiting for completion of the DME transfer of all the memory blocks of memory module 64, summing buffer 40 begins clearing the contents of the unlocked memory block(s) (84). Control unit 66 may begin the clearing action upon request by coordination module 32 (FIG. 2). Control unit 66 blocks the clearing action when it reaches a block of memory that is still locked.

When coordination module 32 requests summing buffer 40 to clear unlocked blocks of memory module 64, coordination module 32 enables audio processing elements 34 to send requests to summing buffer 40 to sum waveform samples for the next audio frame. Coordination module 32 may enable the processing elements 34 before summing buffer 40 has actually performed the clearing action. Summing buffer 40 receives waveforms samples from processing elements 34 (86). Summing buffer 40 may present a similar or identical interface to each of processing elements 34A-34N via round-robin arbiter 60. Round-robin arbiter 60 arbitrates requests from processing elements 34 in a round-robin fashion, and processes winning requests in turn (88). Round robin arbiter 60 blocks requests from processing elements 34 that have lost an arbitration (90) until summing buffer 40 has finished servicing the current request, at which time round robin arbiter 60 re-opens arbitration.

When one of processing elements 34 wins arbitration (YES branch of 88), control unit 66 checks the address of the waveform sample included with the request by processing element 34, to determine whether the waveform sample would fall within a locked memory block or an unlocked memory block (92). For example, control unit 66 may compare the address of the waveform sample to a lock "thermometer" value that indicates a starting address of where within memory module 64 locked memory blocks remain. If the comparison indicates that the waveform sample address is within a locked memory block, control unit 66 blocks the request (94).

If the address is within an unlocked memory block (YES branch of 92), control unit 66 forwards the request to memory module 64 when an accumulation function is enabled. When an accumulation function is disabled, control unit 66 skips reading of memory module 64, and simply writes the received waveform samples to memory module 64. As described above, control unit 66 may operate differently at this point dependent on a mode as dictated by signals received with the processing element request. Control unit 66 blocks other requests from being forwarded to memory module 64 while the current request is being serviced. When the current 2C channel sums (left and right channel sums are retrieved simultaneously) are available from memory module 64, accumulator and saturation logic unit 62 accumulates each sum with its corresponding 2C channel sample received from the processing element using 2C addition and may saturate at 24 bits (96). Round-robin arbiter 60 then re-opens arbitration among processing elements 34. Control unit 66 writes the accumulated waveform sums to memory module 64 (assuming no write-back stalls) (98). In the case that summing buffer 40 receives a new request for the same address to which is currently being written, memory module 64 gives the write-back operation priority to prevent data corruption. If a clear operation is currently in progress and a write-back occurs, memory module 64 gives the write-back operation priority (e.g., using a fixed-priority arbiter).

When all the memory blocks have been transferred via DME to DSP 12 for the previous frame being read (NO branch of 100), and no more sample sums remain to be written to memory module 64 for the current frame being written (NO branch of 102), coordination module 32 sends an interrupt to DSP 12, which initiates a new DME transfer of the contents of memory module 64 for the current frame. The DME may occur when DSP 12 is idle, and, as a result, any DME stalls will reduce the available processing time for the next frame.

As a result of these techniques, summing buffer 40 may receive waveform samples from processing elements 34 and store the resulting waveform sums to memory module 64 for a given frame even while the DME transfer of waveform sums is still in progress for the previous frame. In this manner, summing buffer 40 is designed to efficiently sum waveform samples from audio processing elements 34 and provide the resulting waveform sums for each frame to DSP 12.

Various examples have been described. One or more aspects of the techniques described herein may be implemented in hardware, software, firmware, or combinations thereof. Any features described as modules or components may be implemented together in an integrated logic device or separately as discrete but interoperable logic devices. If implemented in software, one or more aspects of the techniques may be realized at least in part by a computer-readable medium comprising instructions that, when executed, performs one or more of the methods described above. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

The instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, one or more aspects of this disclosure may be directed to a circuit, such as an integrated circuit, chipset, ASIC, FPGA, logic, or various combinations thereof configured or adapted to perform one or more of the techniques described herein. The circuit may include both the processor and one or more hardware units, as described herein, in an integrated circuit or chipset.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

Various aspects and examples have been described. However, modifications can be made to the structure or techniques of this disclosure without departing from the scope of the following claims. For example, other types of devices could also implement the audio processing techniques described herein. Also, although the exemplary hardware unit 20, shown in FIG. 2 uses a wave-table based approach to voice synthesis, other approaches including frequency modulation synthesis approaches could also be used. These and other embodiments are within the scope of the following claims.

The invention claimed is:

1. A method comprising:

summing a waveform sample received from an audio processing element to produce a waveform sum associated with a first audio frame;

storing the waveform sum associated with the first audio frame in a memory, wherein the memory is logically partitioned into a plurality of memory blocks;

locking memory blocks containing the waveform sum associated with the first audio frame;

transferring contents of the locked memory blocks to an external processor on a block-by-block basis;

unlocking a memory block after contents of the memory block have been transferred to the external processor; and storing a waveform sum associated with a second audio frame within the unlocked memory block concurrently with transferring contents of remaining locked memory blocks containing waveform sums associated with the first audio frame.

2. The method of claim 1, wherein locking the memory blocks comprises preventing the locked memory blocks from being accessed.

3. The method of claim 1, further comprising clearing the unlocked memory block prior to storing the waveform sum associated with the second audio frame within the unlocked memory block.

4. The method of claim 1, further comprising:

receiving a sample number indicating an address of a target memory block within the memory at which the waveform sum associated with the first audio frame should be stored; and comparing the sample number to a value representing a location within memory of locked memory blocks to determine whether a memory block associated with the indicated address is currently locked, and wherein the memory stores the waveform sum associated with the first audio frame when the target memory block is not currently locked.

5. The method of claim 4, further comprising blocking the waveform sum associated with the first audio frame from being stored when the memory block associated with the indicated address is currently locked.

6. The method of claim 1, further comprising:

receiving a plurality of waveform samples from a plurality of audio processing elements, wherein summing the waveform sample comprises adding each of the waveform samples received from the plurality of audio processing elements at respective instances of time within the first audio frame.

7. The method of claim 1, wherein transferring contents comprises outputting an audio sample representative of an overall audio compilation within the first audio frame.

8. The method of claim 1, wherein locking the memory blocks comprises locking the memory blocks in response to a request received from the external processor to transfer the contents of the memory.

9. The method of claim 1, further comprising arbitrating requests to sum waveform samples received from a plurality of audio processing elements according to round-robin arbitration.

10. The method of claim 1, wherein summing the waveform sample comprises accumulating the waveform sample using two's complement accumulation.

11. The method of claim 1, wherein summing a waveform sample received from an audio processing element to produce a waveform sum associated with a first audio frame comprises summing a musical instrument digital interface (MIDI) waveform sample received from a MIDI processing element to produce a MIDI waveform sum associated with a first MIDI frame.

12. A device comprising:

an accumulator that sums a waveform sample received from an audio processing element to produce a waveform sum associated with a first audio frame;

a memory that stores the waveform sum associated with the first audio frame, wherein the memory is logically partitioned into a plurality of memory blocks; and a control unit that locks memory blocks containing the waveform sum associated with the first audio frame, wherein the control unit transfers contents of the locked memory blocks to an external processor on a block-by-block basis, and unlocks a memory block after contents of the memory block have been transferred to the external processor, and wherein the memory stores a waveform sum associated with a second audio frame within the unlocked memory block concurrently with the control unit transferring contents of remaining locked memory blocks containing waveform sums associated with the first audio frame.

13. The device of claim 12, wherein the locking of the memory blocks by the control unit prevents the locked memory blocks from being accessed.

14. The device of claim 12, wherein the control unit clears the unlocked memory block prior to storing the waveform sum associated with the second audio frame within the unlocked memory block.

15. The device of claim 12, wherein the device receives a sample number indicating an address of a target memory block within the memory at which the waveform sum associated with the first audio frame should be stored, wherein the control unit compares the sample number to a value representing a location within memory at which memory blocks are currently locked to determine whether a memory block associated with the indicated address is currently locked, and wherein the memory stores the waveform sum associated with the first audio frame when the target memory block is not currently locked.

16. The device of claim 15, wherein the control unit blocks the memory from storing the waveform sum associated with the first audio frame when the memory block associated with the indicated address is currently locked.

17. The device of claim 12, wherein the device receives a plurality of waveform samples from a plurality of audio processing elements, and wherein the accumulator adds each of the waveform samples received from the plurality of audio processing elements at respective instances of time within the first audio frame.

18. The device of claim 12, wherein the control unit outputs an audio sample representative of an overall audio compilation within the first audio frame.

19. The device of claim 12, wherein the control unit locks the memory blocks in response to a request received from the external processor to transfer the contents of the memory.

20. The device of claim 12, further comprising an arbiter that arbitrates requests to sum waveform samples received from a plurality of audio processing elements according to round-robin arbitration.

21. The device of claim 12, wherein the accumulator accumulates the waveform sample using two's complement accumulation.

22. The device of claim 12, wherein the waveform sample comprises a musical instrument digital interface (MIDI) waveform sample, the waveform sum comprises a MIDI waveform sum, and the first and second audio frames comprise first and second MIDI frames.

23. A device comprising:

means for summing a waveform sample received from an audio processing element to produce a waveform sum associated with a first audio frame;

means for storing the waveform sum associated with the first audio frame, wherein the means for storing is logically partitioned into a plurality of memory blocks;

means for locking blocks containing the waveform sum associated with the first audio frame;

means for transferring contents of the locked memory blocks to an external processor on a block-by-block basis; and means for unlocking a memory block after contents of the memory block have been transferred to the external processor, wherein a waveform sum associated with a second audio frame is stored within the unlocked memory block by the means for storing concurrently with contents of remaining locked memory blocks containing waveform sums associated with the first audio frame being transferred to the external processor by the means for transferring.

24. The device of claim 23, wherein the means for locking prevents the locked memory blocks from being accessed.

25. The device of claim 23, further comprising means for clearing the unlocked memory block prior to storing the waveform sum associated with the second audio frame within the unlocked memory block.

26. The device of claim 23, further comprising:

means for receiving a sample number indicating an address of a target memory block within the means for storing at which the waveform sum associated with the first audio frame should be stored;

means for comparing the sample number to a value representing a location within the means for storing at which memory blocks are currently locked to determine whether a memory block associated with the indicated address is currently locked, wherein the means for storing stores the waveform sum associated with the first audio frame when the target memory block is not currently locked.

27. The device of claim 26, further comprising means for blocking the memory from storing the waveform sum associated with the first audio frame when the memory block associated with the indicated address is currently locked.

28. The device of claim 23, further comprising:

means for receiving a plurality of waveform samples from a plurality of audio processing elements, wherein the means for summing adds each of the waveform samples received from the plurality of audio processing elements at respective instances of time within the first audio frame.

29. The device of claim 23, wherein the means for locking locks the memory blocks in response to a request received from the external processor to transfer the contents of the means for storing.

30. The device of claim 23, further comprising means for arbitrating requests to sum waveform samples received from a plurality of audio processing elements according to round-robin arbitration.

31. The device of claim 23, wherein the means for summing accumulates the waveform sample using two's complement accumulation.

32. The device of claim 23, wherein the waveform sample comprises a musical instrument digital interface (MIDI) waveform sample, the waveform sum comprises a MIDI waveform sum, and the first and second audio frames comprise first and second MIDI frames.

33. A computer-readable medium comprising instructions that upon execution cause one or more processors to:

sum a waveform sample received from an audio processing element to produce a waveform sum associated with a first audio frame;

store the waveform sum associated with the first audio frame in a memory, wherein the memory is logically partitioned into a plurality of memory blocks;

lock memory blocks containing the waveform sum associated with the first audio frame;

transfer contents of the locked memory blocks to an external processor on a block-by-block basis;

unlock a memory block after contents of the memory block have been transferred to the external processor; and store a waveform sum associated with a second audio frame within the unlocked memory block concurrently with transferring contents of remaining locked memory blocks containing waveform sums associated with the first audio frame.

34. The computer-readable medium of claim 33, wherein locking the memory blocks comprises preventing the locked memory blocks from being accessed.

35. The computer-readable medium of claim 33, further comprising instructions that upon execution cause the one or more processors to clear the unlocked memory block prior to storing the waveform sum associated with the second audio frame within the unlocked memory block.

36. The computer-readable medium of claim 33, further comprising instructions that upon execution cause the one or more processors to:

receive a sample number indicating an address of a target memory block within the memory at which the waveform sum associated with the first audio frame should be stored; and compare the sample number to a value representing a location within memory of locked memory blocks to determine whether a memory block associated with the indicated address is currently locked, wherein storing the waveform sum associated with the first audio frame in the memory comprises storing the waveform sum when the target memory block is not currently locked.

37. The computer-readable medium of claim 36, further comprising instructions that upon execution cause the one or more processors to block the waveform sum associated with the first audio frame from being stored when the memory block associated with the indicated address is currently locked.

38. The computer-readable medium of claim 33, further comprising instructions that upon execution cause the one or more processors to:

receive a plurality of waveform samples from a plurality of audio processing elements, wherein summing the waveform sample comprises adding each of the waveform samples received from the plurality of audio processing elements at respective instances of time within the first audio frame.

39. The computer-readable medium of claim 33, wherein transferring contents comprises outputting an audio sample representative of an overall audio compilation within the first audio frame.

40. The computer-readable medium of claim 33, wherein locking the memory blocks comprises locking the memory blocks in response to a request received from the external processor to transfer the contents of the memory.

41. The computer-readable medium of claim 33, further comprising instructions that upon execution cause the one or more processors to arbitrate requests to sum waveform samples received from a plurality of audio processing elements according to round-robin arbitration.

42. The computer-readable medium of claim 33, wherein summing the waveform sample comprises accumulating the waveform sample using two's complement accumulation.

43. The computer-readable medium of claim 33, wherein summing a waveform sample received from an audio processing element to produce a waveform sum associated with a first audio frame comprises summing a musical instrument digital interface (MIDI) waveform sample received from a MIDI processing element to produce a MIDI waveform sum associated with a first MIDI frame.

44. A circuit adapted to:

sum a waveform sample received from an audio processing element to produce a waveform sum associated with a first audio frame;

store the waveform sum associated with the first audio frame in a memory, wherein the memory is logically partitioned into a plurality of memory blocks;

lock memory blocks containing the waveform sum associated with the first audio frame;

transfer contents of the locked memory blocks to an external processor on a block-by-block basis;

unlock a memory block after contents of the memory block have been transferred to the external processor; and store a waveform sum associated with a second audio frame within the unlocked memory block concurrently with transferring contents of remaining locked memory blocks containing waveform sums associated with the first audio frame.

45. The circuit of claim 44, wherein locking the memory blocks comprises preventing the locked memory blocks from being accessed.

46. The circuit of claim 44, wherein the circuit is adapted to clear the unlocked memory block prior to storing the waveform sum associated with the second audio frame within the unlocked memory block.

47. The circuit of claim 44, wherein the circuit is adapted to:

receive a sample number indicating an address of a target memory block within the memory at which the waveform sum associated with the first audio frame should be stored; and compare the sample number to a value representing a location within memory of locked memory blocks to determine whether a memory block associated with the indicated address is currently locked, wherein storing the waveform sum associated with the first audio frame in the memory comprises storing the waveform sum when the target memory block is not currently locked.

48. The circuit of claim 47, wherein the circuit is adapted to block the waveform sum associated with the first audio frame from being stored when the memory block associated with the indicated address is currently locked.

49. The circuit of claim 44, wherein the circuit is adapted to:

receive a plurality of waveform samples from a plurality of audio processing elements, wherein summing the waveform sample comprises adding each of the waveform samples received from the plurality of audio processing elements at respective instances of time within the first audio frame.

50. The circuit of claim 44, wherein transferring contents comprises outputting an audio sample representative of an overall audio compilation within the first audio frame.

51. The circuit of claim 44, wherein locking the memory blocks comprises locking the memory blocks in response to a request received from the external processor to transfer the contents of the memory.

52. The circuit of claim 44, wherein the circuit is adapted to arbitrate requests to sum waveform samples received from a plurality of audio processing elements according to round-robin arbitration.

53. The circuit of claim 44, wherein summing the waveform sample comprises accumulating the waveform sample using two's complement accumulation.

54. The circuit of claim 44, wherein summing a waveform sample received from an audio processing element to produce a waveform sum associated with a first audio frame comprises summing a musical instrument digital interface (MIDI) waveform sample received from a MIDI processing element to produce a MIDI waveform sum associated with a first MIDI frame.

* * * * *

UNITED STATES PATENT AND TRADEMARK OFFICE

CERTIFICATE OF CORRECTION

PATENT NO. : 7,723,601 B2
APPLICATION NO. : 12/041855
DATED : May 25, 2010
INVENTOR(S) : Kamath et al.

It is certified that error appears in the above-identified patent and that said Letters Patent is hereby corrected as shown below:

Title Pg, Item (75), Inventor's address: "Placentia" to read as --San Diego--

Title Pg, line 5, Inventor's Name: Prajakt V Kulkarni" to read as --Prajakt Kulkarni--

Column 17, line 47, claim 23: "block" to read as --memory blocks--

Signed and Sealed this
Twenty-eighth Day of June, 2011

David J. Kappos

David J. Kappos
*Director of the United States Patent and Trademark Office*